US008936378B2

(12) United States Patent
Li

(10) Patent No.: US 8,936,378 B2
(45) Date of Patent: Jan. 20, 2015

(54) LED LIGHT SOURCE

(75) Inventor: Changxing Li, Guizhou (CN)

(73) Assignee: Chongqing Shangchuan Investments Co., Ltd., Chongqing (CN)

( * ) Notice: Subject to any disclaimer, the term of this patent is extended or adjusted under 35 U.S.C. 154(b) by 0 days.

(21) Appl. No.: 14/238,710

(22) PCT Filed: Jun. 21, 2012

(86) PCT No.: PCT/CN2012/077283

§ 371 (c)(1),
(2), (4) Date: Feb. 12, 2014

(87) PCT Pub. No.: WO2013/023488

PCT Pub. Date: Feb. 21, 2013

(65) Prior Publication Data

US 2014/0211468 A1 Jul. 31, 2014

(30) Foreign Application Priority Data

| | | |
|---|---|---|
| Aug. 12, 2011 | (CN) | 2011 2 03054664 U |
| Aug. 12, 2011 | (CN) | 2011 2 03054683 U |
| Nov. 14, 2011 | (CN) | 2011 2 04475764 U |
| Dec. 28, 2011 | (CN) | 2011 2 05593363 U |
| Dec. 28, 2011 | (CN) | 2011 2 05600831 U |

(51) Int. Cl.
*F21V 29/02* (2006.01)
*F21V 29/00* (2006.01)

(52) U.S. Cl.
CPC ..... *F21V 29/22* (2013.01)
USPC ..... 362/235; 362/225; 362/218

(58) Field of Classification Search
CPC . F21V 29/004; F21V 29/2293; F21V 29/006; F21V 29/02; F21V 29/30; F21V 3/00; F21V 3/005; F21V 29/248; F21V 29/20; F21V 5/04; F21V 29/00; F21V 29/002; F21V 33/0088; F21K 9/1355; F21K 9/175
USPC ..... 362/218, 480, 546, 547, 294, 373, 555, 362/249.01, 249.02, 311.01, 311.02, 362/341–361, 326–335, 296.05, 296.06, 362/296.07, 296.08, 375, 290–310, 362/433–457, 217.02–217.17, 217.01, 362/223–225, 235–237, 227, 240–248, 362/362–365; 313/17, 20, 33, 46, 45; 439/487
See application file for complete search history.

(56) References Cited

U.S. PATENT DOCUMENTS

| | | | |
|---|---|---|---|
| 6,945,672 | B2 | 9/2005 | Du et al. |
| 7,114,837 | B2 | 10/2006 | Yagi et al. |

(Continued)

FOREIGN PATENT DOCUMENTS

| | | | |
|---|---|---|---|
| AU | 2003262699 | A1 | 3/2004 |
| AU | 2003262699 | A8 | 3/2004 |

(Continued)

*Primary Examiner* — Anh Mai
*Assistant Examiner* — Fatima Farokhrooz
(74) *Attorney, Agent, or Firm* — Locke Lord LLP

(57) ABSTRACT

A LED light source, comprising a heat-dissipation base, a circuit base is fixed on the heat-dissipation base, and luminous LED(s) is fixed on the circuit base, a light-distribution lens is sealed connected outside the heat-dissipation base, a housing is fixed outside the light-distribution lens, and front ends of the housing and the light-distribution lens are separately fixed jointed to a light-transmitting cover, the light-transmitting cover is sealed connection with the heat-dissipation base, the circuit base and LEDs are located within a sealed first chamber formed by the heat-dissipation base, light-distribution lens and light-transmitting cover, at least a channel is further arranged on the heat-dissipation base, each channel is disconnected to the first chamber, and two opposite openings of each channel are connected to the exterior. The LED light source has a good heat-dissipation performance, particularly to be used for high-power LED illumination.

15 Claims, 4 Drawing Sheets

(56) References Cited

U.S. PATENT DOCUMENTS

| | | | | |
|---|---|---|---|---|
| 2004/0042212 | A1 | 3/2004 | Du et al. | |
| 2011/0026257 | A1* | 2/2011 | Holten et al. | 362/260 |
| 2011/0096543 | A1* | 4/2011 | Yabe et al. | 362/235 |

FOREIGN PATENT DOCUMENTS

| | | | |
|---|---|---|---|
| CN | 1701446 | A | 11/2005 |
| CN | 2761964 | Y | 3/2006 |
| CN | 200940816 | Y | 9/2007 |
| CN | 101368714 | A | 2/2009 |
| CN | 201382351 | Y | 1/2010 |
| CN | 102095181 | A | 6/2011 |
| CN | 102287792 | A | 12/2011 |
| CN | 102410483 | Y | 4/2012 |
| CN | 102494292 | A | 6/2012 |
| CN | 102519021 | A | 6/2012 |
| EP | 1537607 | A2 | 6/2005 |
| JP | 2004311224 | A | 11/2004 |
| JP | 2005537665 | A | 12/2005 |
| JP | 2007059075 | A | 3/2007 |
| JP | 2008041558 | A | 2/2008 |
| WO | 2004021460 | A2 | 3/2004 |
| WO | 2004021460 | A3 | 6/2004 |

* cited by examiner

LED LIGHT SOURCE

FIELD OF THE INVENTION

The present invention relates to a field of LED illumination and, more particularly, to a LED light source.

BACKGROUND OF THE INVENTION

With development of electrical technology, heat dissipation problem has been already to become an important factor to restrict the improvement of device power and product life.

Particularly, the advantages of LED used as a new environmental friendly light source are more significantly, but heat dissipation of intense light source of LED functional lighting is an unsolved worldwide technical problem, so that impeding the applications of LED functional lighting as intense light source. For example, the promotion of high-power LED light source, such as automobile lamps, large-scale LED light source for steamship, LED street lamp, and searchlight etc., are more constrained by the heat dissipation.

SUMMARY OF THE INVENTION

The first object of the embodiment according to the present invention is to provide a LED light source with a good heat-dissipation performance, particularly to be used for high-power LED illumination.

The second object of the embodiment according to the present invention is to provide another LED light source having a good heat-dissipation performance, particularly to be used for high-power LED illumination.

A LED light source according to a first embodiment of the present invention, comprising a heat-dissipation base, a circuit base is fixed on the heat-dissipation base, and luminous LED(s) is fixed on the circuit base, a light-distribution lens is sealed connected outside the heat-dissipation base, a housing is fixed outside the light-distribution lens, and front ends of the housing and the light-distribution lens are separately fixed jointed to a light-transmitting cover, the light-transmitting cover is sealed connection with the heat-dissipation base, the circuit base and LEDs are located within a sealed first chamber formed by the heat-dissipation base, light-distribution lens and light-transmitting cover, at least a channel is further arranged on the heat-dissipation base, each channel is disconnected to the first chamber, and two opposite openings of each channel are connected to the exterior, rear end of the heat-dissipation is extended outside rear end of the housing,an opening of each channel is located outside the rear end of the housing.

Optionally, the channels are tubular channels formed in the heat-dissipation base; or a plurality of fins are formed on surface of the heat-dissipation base, the channels are grooved channels between any two adjacent fins.

Optionally, all parts of the heat-dissipation base are located on one side of the light-transmitting cover, at least a through hole is arranged on periphery of connection part of the light-transmitting cover and the heat-dissipation base, each through hole is opposite to the opening of each channel on the heat-dissipation base.

Optionally, the heat-dissipation base is extended outside the light-transmitting cover, at least a through hole is arranged on periphery of connection part of the light-transmitting cover and the heat-dissipation base, part of the heat-dissipation is cut through the through hole of the light-transmitting cover and extended outside the light-transmitting cover, an opening of each channel on the heat-dissipation base is located outside the light-transmitting cover.

Optionally, two opposite chimbs are further arranged on the connection part of the light-transmitting cover and the heat-dissipation base ;

the light-transmitting cover is sealed connected with the heat-dissipation base, that is:

the connection part of is spacing sealed fixed between two chimbs of the light-transmitting cover.

Optionally, a first chimb is arranged on the connection part of the housing and the light-distribution lens on the light-transmitting cover, the front ends of the housing and the light-distribution lens are separately fixed to the light-transmitting cover, that is:

the housing is face-to-face sealed fixed on outer side of the first chimb of the light-transmitting cover, the light-distribution lens is face-to-face sealed fixed on inner side of the first chimb.

Optionally, the circuit base comprising: metal substrate, insulated-based material, and routing copper foil;

the LEDs are LED chips, and each LED chip is fixed on the surface of the metal substrate, a insulated layer at the bottom surface of each LED chip is face-contacted with the metal substrate, an electrode pin of each LED chip is welded on the metal substrate, and another electrode pin is electrically connected with the routing copper foil lay in the insulated-based material via lead;

wherein, the insulated-based material is lay on the top surface of the metal substrate except the LED chip fixed area, the routing copper foil is lay in the insulated-based material;

the metal substrate and the routing copper foil are separately electrically connected with anode and cathode of an external supply circuit.

Optionally, a pit is further arranged on the top surface of the metal substrate, the LED chips are fixed on the surface of the metal substrate, that is: the LED chips are fixed on the surface of the pit, the insulated-based material is lay on the top surface of the metal substrate except the LED chip fixed area, that is:

the insulated layer is lay on the top surface area of the metal substrate except the pit area;

another electrode pin of each LED chip is electrically connected with the routing copper foil, that is: another electrode pin of each LED chip is electrically connected with the routing copper foil via the lead;

a silica gel filled part is filled in the pit, and all of the LED chips and leads are packed in the silica gel filled part.

A LED light source according to an embodiment of the present invention comprising: a heat-dissipation base, circuit bases are separately fixed on top and bottom surfaces of the heat-dissipation base, and luminous LED(s) is fixed on each circuit base;

a light-distribution lens is sleeve connected outside the heat-dissipation, a housing is sleeve connected outside the light-distribution lens, the front ends of the housing and light-distribution lens are separately fixed on the light-transmitting cover;

the circuit base located on the top surface of the heat-dissipation base and the LED are located within a first sealed chamber formed by the light-distribution lens, heat-dissipation base and light-transmitting cover, the circuit base located on the bottom surface of the heat-dissipation base and the LED are located within a second sealed chamber formed by the light-distribution lens, heat-dissipation base and light-transmitting cover, at least a tubular channel is further arranged within the heat-dissipation base, and two opposite openings of each channel are connected to the exterior.

Optionally, the rear end of the heat-dissipation base is extended outside the rear end of the housing, an opening of each channel is located outside the rear end of the housing.

Optionally, all parts of the heat-dissipation base are located on one side of the light-transmitting cover, at least a through hole is arranged on the light-transmitting cover, and each through hole is opposite to the opening of each channel on the heat-dissipation base.

Optionally, the heat-dissipation base is extended outside the light-transmitting cover, through hole(s) is arranged on periphery of connection part of the light-transmitting cover and the heat-dissipation base, part of the heat-dissipation is cut through the through hole of the light-transmitting cover and extended outside the light-transmitting cover, an opening of each channel on the heat-dissipation base is located outside the light-transmitting cover.

Optionally, two opposite chimbs are further arranged on the connection part of the light-transmitting cover and the heat-dissipation base; the light-transmitting cover is sealed connected with the heat-dissipation base, that is:

the connection part of the light-transmitting cover and the heat-dissipation base is spacing sealed fixed between two chimbs of the light-transmitting cover.

Optionally, a first chimb is arranged on the connection part of the housing and the light-distribution lens on the light-transmitting cover, the front ends of the housing and the light-distribution lens are separately fixed to the light-transmitting cover, that is :

the housing is face-to-face sealed fixed on outer side of the first chimb of the light-transmitting cover, the light-distribution lens is face-to-face sealed fixed on inner side of the first chimb.

Optionally, the circuit base comprising: metal substrate, insulated-based material, and routing copper foil;

the LEDs are LED chips which are fixed on the surface of the metal substrate, a insulated layer at the bottom surface of each LED chip is face-contacted with the metal substrate, an electrode pin of each LED chip is welded on the metal substrate, and another electrode pin is electrically connected with the routing copper foil lay in the insulated-based material via lead;

wherein, the insulated-based material is lay on the top surface of the metal substrate except the LED chip fixed area, the routing copper foil is lay in the insulated-based material;

the metal substrate and the routing copper foil are separately electrically connected with anode and cathode of an external supply circuit.

Optionally, a pit is further arranged on the top surface of the metal substrate, the LED chips are fixed on the surface of the metal substrate, that is: the LED chips are fixed on the surface of the pit, the insulated-based material is lay on the top surface of the metal substrate except the LED chip fixed area, that is:

the insulated layer is lay on the top surface area of the metal substrate except the pit area;

another electrode pin of each LED chip is electrically connected with the routing copper foil, that is: another electrode pin of each LED chip is electrically connected with the routing copper foil via the lead;

a silica gel filled part is filled in the pit, and all of the LED chips and leads are packed in the silica gel filled part.

It can be seen that when apply the technical solution according to the embodiment of the present invention, turning on the external power supply which is supplied to each LED via the circuit base, then the LEDs are driven by electricity and lighten to exterior. Heat produced during the working process of LEDs is fast transmitted to the heat-dissipation base connected thereto through the circuit base; the fluid, such as air or liquid entering into an opening of the channel arranged in the heat-dissipation base, passing through the heat-dissipation base and fully contacted with the heat-dissipation base, and then taking the heat on the heat-dissipation base away from another opening of the channel, which can achieve cut-through heat dissipation of the fluid and improve the heat dissipation rate of the LED intense light source. According to the experiments, the embodiment of the present invention can achieve a LED high-power light source with super power, whose power may be up to thousands of watts.

In addition, when both openings of each channel are opposite each other, the fluid passed through the channel is entered into one end and fast to flow out of another end, which taking heat of the heat-dissipation base away so as to achieve efficient heat dissipation.

Furthermore, since the channel(s) arranged within the heat-dissipation base is not connected to the first chamber, the fluid passed through does not enter into main electric devices to affect the electrical property.

BRIEF DESCRIPTION OF THE DRAWINGS

The appended drawings intend to help further understanding of the invention, and constitute part of the application, which shall not be construed as improper limitations on the invention. In the appended drawings.

DETAILED DESCRIPTION OF ILLUSTRATED EMBODIMENTS

The present invention is further described in detail below with reference to drawings and embodiments. Here, the exemplary embodiments of the present invention and the illustrations thereof are used to explain the present invention, rather than to limit the present invention.

Figure 1:
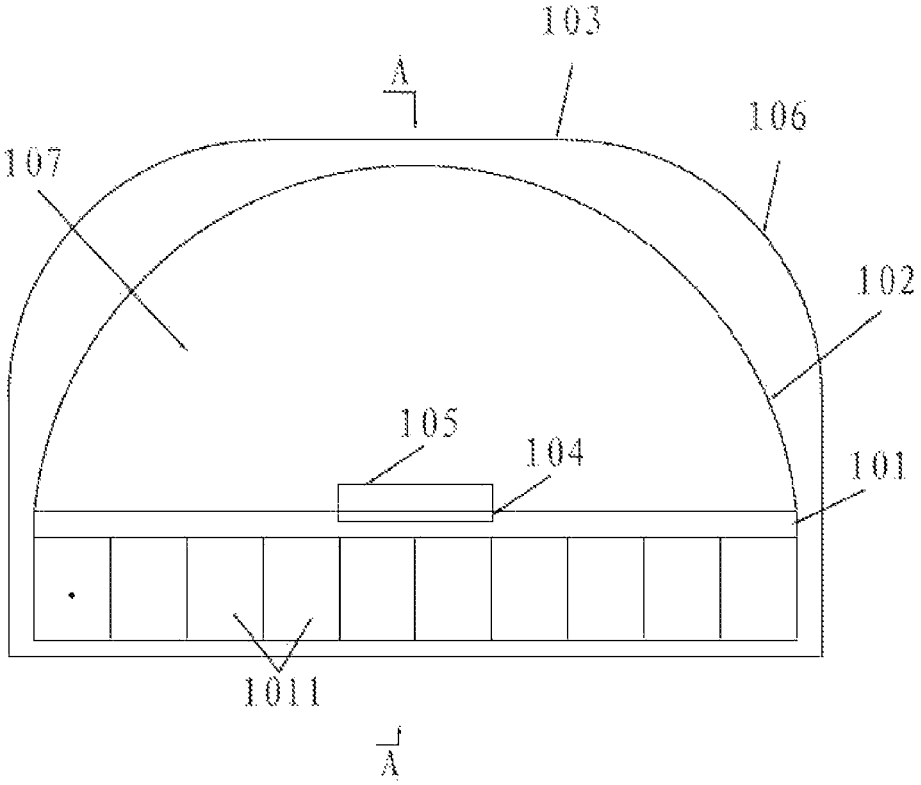
FIG. 1 is a structural schematic view of a LED light source with a heat-dissipation device according to a first embodiment of the present invention.
Figure 2:
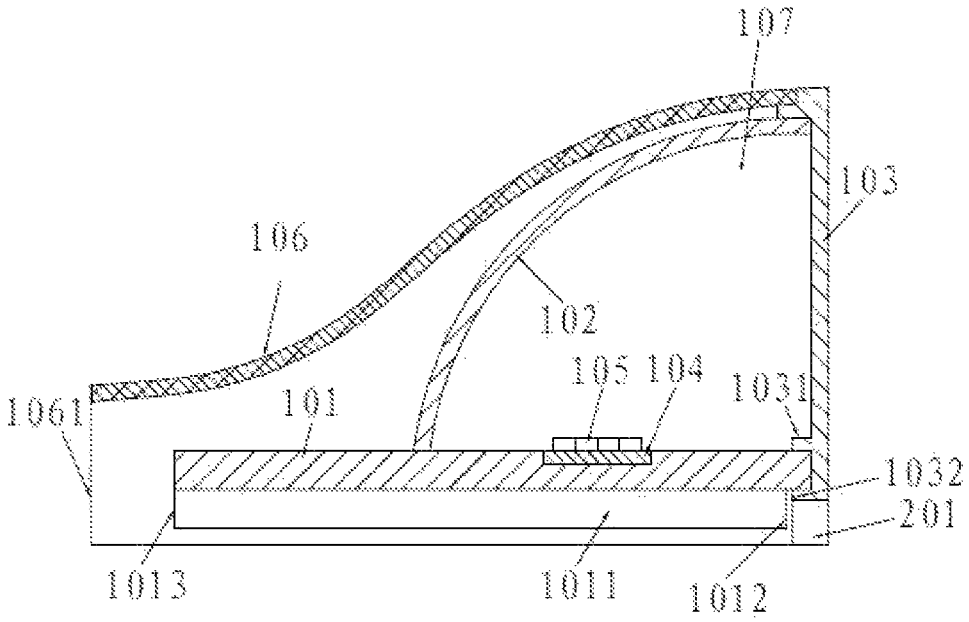
FIG. 2 is an A-A direction sectional view of FIG. 1 according to the first embodiment of the present invention.

Embodiment 1:

It can be referred to FIG. 1 and 2.

A LED light source according to the embodiment mainly comprising: housing 106, heat-dissipation base 101, light-distribution lens 102, light-transmitting cover 103, circuit base 104 and LED 105.

The heat-dissipation base 101 is made of high-performance heat dissipation material, such as, but not limited to be a copper base, aluminum base or copper-aluminum alloy base.

The circuit base 104 is fixed closely to surface of the heat-dissipation base 101, and a power supply circuit for LED 105 is fixed on the circuit base 104. The LED 105 is fixed on the circuit base 104, wherein the LED 105 may be pin-type LED or LED chip. The LED 105 also can be single high-power LED or LED cluster which is formed by a plurality of LEDs, and shape of the LED cluster can be arranged according to specific needs, such as a certain logo pattern, in order to achieve the roles of advertising and projection promotion etc.

The light-distribution lens 102 is fixed outside the heat-dissipation base 101, whose type and shape can be determined according to applied occasions of the high-power LED light source, for example, light-distribution lens 102 for condensing light can be selected to achieve a high-power, long distance and high-intensity illumination.

Rear end of the light-distribution lens 102 is fixed closely to the heat-dissipation base 101, and front end of the light-distribution lens 102 is fixed closely to the light-transmitting cover 103.

The circuit base 104 and the LED arranged thereon are located within a sealed chamber formed by the heat-dissipation base 101, light-distribution lens 102 and light-transmitting cover 103, as a first chamber 107 as shown in FIG. 1.

The housing 106 for protection is fixed outside the light-distribution lens 102, a front opening of the housing 106 is fixed to the light-transmitting cover 103, and a rear end of the housing 106 can be connected and fixed to external parts so as to achieve the assembly.

At least one channel 1011 is further arranged on the heat-dissipation base 101, which is disconnected to the first chamber 107. These channels 1011 can be arranged within the heat-dissipation base 101, or on periphery of the heat-dissipation base 101, of which is not within the first chamber 107.

Two opposite ends 1012, 1013 of each channel 1011 are separately connected to the exterior.

Working principle of the LED light source according to the embodiment is given as following:

Turning on the external power supply which is supplied to each LEDs 105 via the circuit base 104, then the LEDs 105 are driven by electricity and lighten to exterior. Heat produced during the working process of LEDs 105 is fast transmitted to the heat-dissipation base 101 connected thereto through the circuit base 104; the fluid, such as air or liquid entering into an opening 1012 of the channel 1011 arranged in the heat-dissipation base 101, passing through the heat-dissipation base 101 and fully contacted with the heat-dissipation base 101, and then taking the heat on the heat-dissipation base 101 away from an opening 1013 of the channel 1011, which can achieve cut-through heat dissipation of the fluid and improve the heat dissipation rate of the LED intense light source.

According to the experiments, the embodiment of the present invention can achieve a LED high-power light source with super power, whose power may be up to thousands of watts.

In the embodiment, when both openings 1012, 1013 of each channel 1011 are opposite each other, the fluid passed through the channel 1011 is entered into the end and fast to flow out of another end, so that taking heat of the heat-dissipation base 101 away so as to achieve efficient heat dissipation.

In addition, since the channel(s) 1011 arranged within the heat-dissipation base 101 are disconnected to the first chamber 107, the fluid passed through does not enter into main electric devices to affect the electrical property.

In the embodiment, whole parts of the heat-dissipation base 101 is located within the housing 106; as shown in FIG. 2, at least one or a plurality of through hole(s) 201 is arranged on periphery of connection part of the light-transmitting cover 103 and the heat-dissipation base 101, the through hole(s) 201 is opposite to one end of the channel 1011 on the heat-dissipation base 101. The principle of fluid heat dissipation is given:

The fluid (such as water or air) entering into the through hole 201 on the light-transmitting cover 103, and entering into the channel 1011 through an opening of the channel 1011 on the heat-dissipation base 101, passing through another opening 1013 of the channel 1011, then flowing out from the rear end 1061 of the housing 106.

In the embodiment, the rear end of the heat-dissipation base 301 may be extended outside the rear end 1061 of the housing 106. Regarding to FIG. 3, by use of this design, the fluid (such as water or air) entering into the through hole 201 on the light-transmitting cover 103, and entering into a channel 3011 through an opening 3012 of the channel 3011 on the heat-dissipation base 301, then passing through another opening 3013 of the channel 3011 directly to the exterior. This design may enlarge the volume of the heat-dissipation base 301 which will not be restricted by the housing, so that further improving the effect of heat dissipation.

Figure 4:
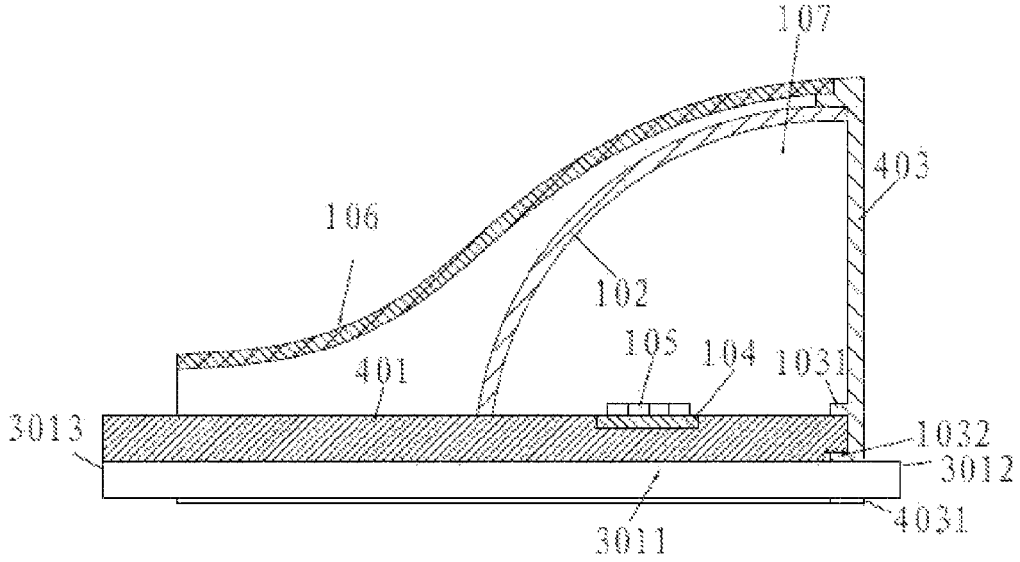
FIG. 4 is a sectional structure schematic view of LED light source with a heat-dissipation base whose front end is extended outside the light-transmitting cover according to the first embodiment of the present invention.

In the embodiment, the front end of the heat-dissipation base 401 may be provided to extend outside the light-transmitting cover 403, as shown in FIG. 4. Through hole 4031 can be arranged on the periphery of the connection part of the light-transmitting cover 403 and the heat-dissipation base 401 on the light-transmitting cover 403, which is provided for the front end of the heat-dissipation base 401 may be extended out, such that the front end 4012 of the heat-dissipation base 401 is extended outside the light-transmitting cover 403. The principle of fluid heat dissipation is given:

The fluids such as water or air may enter into the opening 4012 of the heat-dissipation base 401 extended outside the light-transmitting cover 403, and then flow out of another opening 4013 of the channel 4011 extended outside the rear end of the housing. On one side, an advantage of this technology is to improve the heat-dissipation volume of the heat-dissipation base 401, that is improve the efficiency of heat dissipation; on another side, since the openings 4012 and 4013 of the channel 4011 are arranged outside the housing and the light-transmitting cover 403, if all of the channels 4011 are provided as tubular structure, not groove structure, it can be guaranteed that fluids directly pass through the heat-dissipation base 401, which is not necessary to through any part in the housing, that is directly enter from exterior and flow out to the exterior, and further to guarantee the safety of electric devices within the housing.

Figure 3:
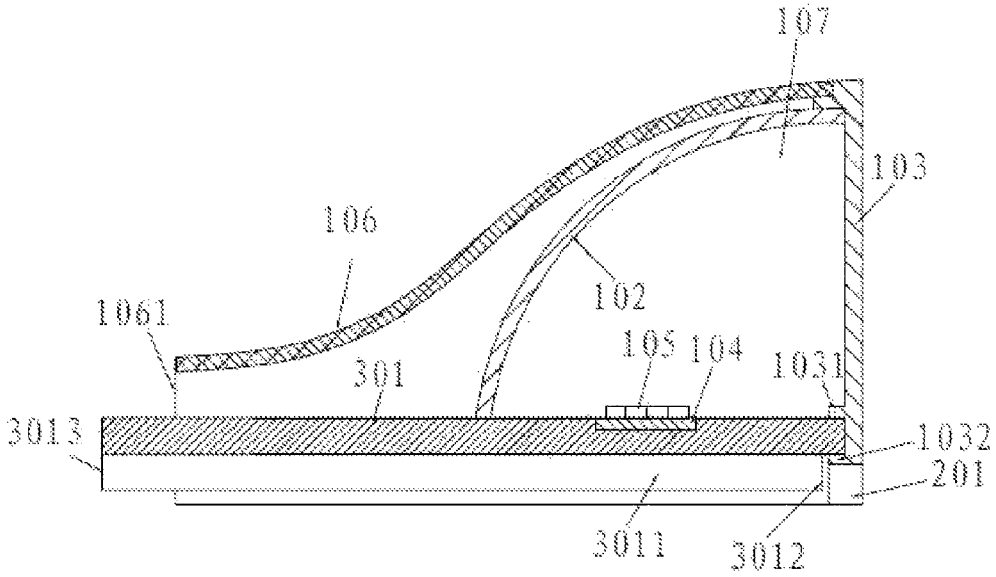
FIG. 3 is a sectional structure schematic view of LED light source with a heat-dissipation base whose rear end is extended outside the rear end of the housing according to the first embodiment of the present invention.

Referring to FIGS. 2, 3 and 4, in order to improve the closely connection between the light-transmitting cover and heat-dissipation base, two opposite chimbs 1031 and 1032 are arranged within the connection part of the light-transmitting cover and heat-dissipation base. During assembly process, the connection part of the light-transmitting cover and heat-dissipation base is spaced within two chimbs 1031 and 1032, which is tightly connected to a space formed by two chimbs 1031 and 1032. Such structure may be further improving tightness of the connection of the heat-dissipation base and light-transmitting cover, and this face-to-face interference fit connection may further guaranteeing the sealing of the first chamber and the stability of electric devices therein.

In this embodiment, the channels 1011, 3011 and 4011 on the heat-dissipation bases 101, 301 and 401 may be tubular channels arranged within the heat-dissipation bases, or a plurality of fins may be arranged on the reverse side of the heat-dissipation base, and grooves between the fins can be used as the grooved channels for the fluids in the heat-dissipation base.

Figure 5:
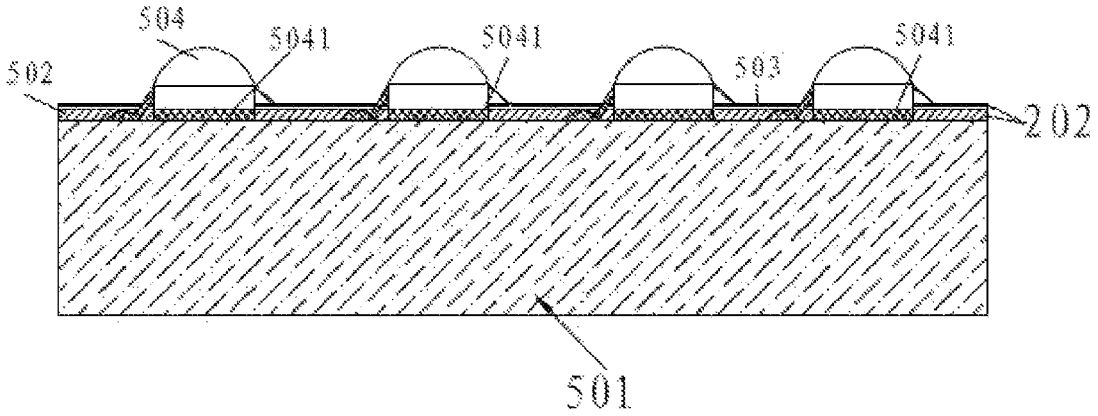
FIG. 5 is a schematic view of connection structure of circuit base for fixing LED and LED arranged thereon according to the first embodiment of the present invention.

In addition, after long-term experiments, it can be found that above described circuit base may be widely used PCB circuit or the likes, or the technical solution as below:

As shown in FIG. 5, the circuit base of the present invention mainly comprising: metal substrate 501, insulated-based material 502, and routing copper foil 503. The metal substrate 501 may be, but not limited to copper plate, aluminum plate or other metal plates, the insulated-based material 502 may be PCB insulated-based material used in circuit fabrication, and the LEDs arranged on the circuit substrate are LED chips. The connection relationship of above components is given: The bottom surface of the metal substrate 501 and the heat-dissipation base contiguously arranged on the surface of heat-dissipation base; the LED chips 504 are separately fixed on the top surface of the metal substrate 501; a insulating layer 5041 at the bottom surface of each LED chip is face-contacted with the metal substrate 501 at the bottom surface of this LED chip; an electrode pin of LED chip 504 is welded on the metal substrate 501 at the bottom surface of the LED chip 504, and another electrode pin is electrically connected with the routing copper foil 503 lay in the insulated-based material 502 via the lead; and the insulated-based material 502 is lay on the top surface of the metal substrate 501 except the LED chip 504 fixed area. The metal substrate 501 and the routing copper foil 503 may be separately electrically connected with anode and cathode of the external supply circuit.

And the working principle is that: Direct current is introduced to the metal substrate 501 and routing copper foil 503 by means of the external supply circuit, and the LED chip 504 is electrically connected between the metal substrate 501 and routing copper foil 503 are driven by the introduced current to work and light to the exterior.

In the above technical solution, it can be seen that the LED chips 504 are directly face-to-face contact fixed on the metal substrate 501; the insulating layer 5041 at the bottom surface of the LED chip 504 is face-to-face contacted with the metal substrate 501; and an electrode pin of each LED chips 504 is welded on the metal substrate 501, and another electrode pin is electrically connected with the routing copper foil 503 lay in the insulated-based material 502 via the lead.

In the application, working power of direct current is introduced to the LED chips by means of the metal substrate 501 and routing copper foil 503, and heat produced during the working process of LED chips 504 can be fast transmitted to the metal substrate 501 with a good performance of heat dissipation via contacted thermal conduction, and then the heat fast transmitting from the LED chips 504 to the heat-dissipation base by the metal substrate 501, which is further dissipated by the heat-dissipation base. This technical solution can further improve the effect of heat dissipation in relative to the prior art of die bonding technology such as welding the LED chips 504 on the anode-cathode routing copper foils 503 of the general PCB substrate.

Furthermore, since the metal substrate 501 and heat-dissipation base are contacted closely each other according to the embodiment, the heat-dissipation base can be applied as electrode conductor whose polarity is same as the metal substrate 501 except for heat dissipation during the working process of LED chips 504. By reason of the larger volume of the heat-dissipation base, the technical solution of the present invention may further reduce internal resistance of LED lights and heat, in order to avoid the conductors are burned out as over heat of long-term use, that is further increase service life and stability.

Figure 6:
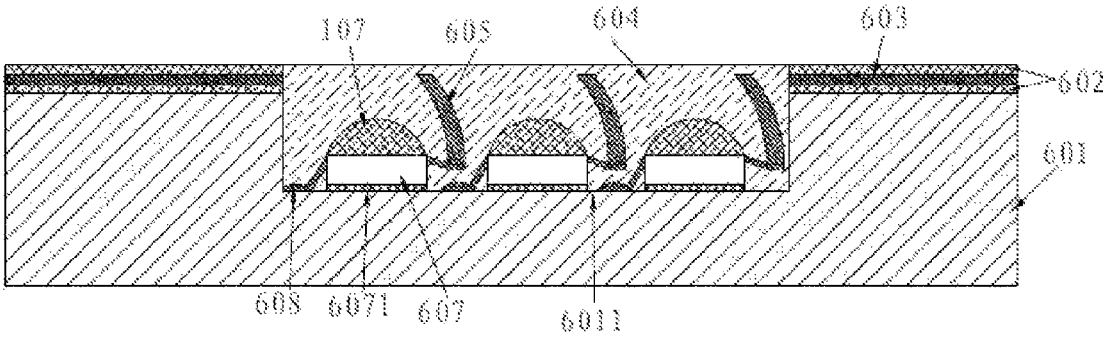
FIG. 6 is a schematic view of another connection structure of circuit base for fixing LED and LED arranged thereon according to the first embodiment of the present invention.

In order to further improving the stability of the LED chips 607 on the circuit base, it can be used the technical solution as shown in FIG. 6 that fixing the LED chip 607 on the metal substrate 601.

The circuit base according to the embodiment of the present invention comprising: metal substrate 601, insulated-based material 602, and routing copper foil 603, silica gel filled part 604, and a plurality of leads 605.

A pit 6011 is provided on the top surface of the metal substrate 601, and the insulated-based material 602 is lay on the top surface of the metal substrate 601 except the pit 6011 area. A plurality of routing copper foils 603 are lay on the insulated-based material 602.

A plurality of LED chips 607 are fixed within the pits 6011 of the metal substrate 601, the insulated layer 6071 at the bottom surface of these LED chips 607 is face-to-face contacted with the metal substrate 601 underlie the insulated layer 6071. An electrode pin of each of the LED chips 607 is directly welded on (referring to 608 in the figure) the metal substrate 601 underlie the LED chip 607, and another electrode pin of each LED chips 607 is electrically connected with the routing copper foil 603 which is lay outside the pit 6011 and on the insulated-based material 602.

Fluorescent powder is coated on top surface of each LED chips 607, which will be cured and packed on the top surface of LED chips 607 after coated and then forms a fluorescent powder layer, detailed preparation and coating process of the fluorescent powder may be, but not limited to be referred the prior art. The fluorescent powder can adjust the light emitted from the LED chips 607 and emit a predetermined color light to the exterior, such as yellow light, white light etc., mostly as white light in general application.

Silica gel filled part 604 is filled in the pit 6011, which can be used as an exposed and protection layer is covered on the top surface of the pits 6011, this silica gel filled part 604 is fully filled in the pits 6011, and the LED chips 607, the leads 605 and the fluorescent powder layer in the pits 6011 are packed tightly in the silica gel filled part 604.

In the application, the cathode of the external DC power supply is electrically connected with the metal substrate 601, and the anode of the external DC electrical source is electrically connected with the routing copper foil 603. During energizing, the routing copper foil 603 becomes to be anode of the power supply, and the large-area metal substrate 601 at the bottom becomes to be cathode of the power supply, both of which provide working power supply for the LED chips 607 welded on the metal substrate 601 and introduce working current to the LED chips 607. The LED chips drove by electricity emits light, and the light passes through the fluorescent powder layer and silica gel filled part 604, then emits to the exterior, which achieves illumination.

It can be seen that since the LED chips are fixed on the metal substrate according to the embodiment, so that the insulated layer at the bottom surface of these LED chips are face-to-face contacted with the metal substrate. An electrode pin of each LED chip is directly welded on the metal substrate, and another electrode pin is electrically connected with the routing copper foil lay in the insulated-based material via the lead. In the application, direct current working power is introduced to the LED chips by means of the metal substrate and routing copper foil, and heat produced during the working process of LED chips can be fast transmitted to the metal substrate with a good performance of heat dissipation via contacted thermal conduction, and then the heat fast transmitting from the LED chips to the heat-dissipation base by the metal substrate, which is further dissipated by the heat-dissipation base. This technical solution can further improve the effect of heat dissipation in relative to the prior art of die bonding technology such as welding the LED chips on the anode and cathode routing copper foils of the general PCB substrate.

As an optional implementation plan of this embodiment, the anode of LED chips may be welded on the metal substrate, and the cathode of LED chips may be connected to the routing copper foil outside the pit via the leads. In the application, the cathode input terminal of the external DC power supply may be electrically connected with the routing copper foil, the anode input terminal is electrically connected with the metal substrate, and the optional implementation plan may be selected according to the actual application occasions.

As a preferably implementation plan of the embodiment, the cathode of each LED chips may be welded on the metal substrate, and the anode of each LED chips may be electrical connected with the routing copper foil outside the pit via the leads (the electrical connection may be, but not limited to be achieved by welding). In the application, the anode input terminal of the external DC power supply may be electrically connected with the routing copper foil; the cathode input terminal is electrically connected with the metal substrate. Under this condition, since the volume of cathode metal substrate is larger, in relative to the prior art, such as die bonding technology which is to weld the LED chips on the routing copper foil of general PCB, this technical solution is beneficial to increase the stability of current, luminous stability and service life of LED chips.

Moreover, in relative to the prior art that welding LED chips to the anode and cathode routing copper foil lay on the insulated-based material, the embodiment of the present invention is provided that welding LED chips on the solid metal substrate, which breaks the inertial thinking of person skilled in the art and overcome the technical prejudice.

It should be described that the cross section of the housing according to the present invention may be square, circle, ellipse, trapezoid, triangle and one or more consist thereof; the cross section of the heat-dissipation according to the present invention may be square, circle, ellipse, trapezoid, triangle and one or more consist thereof.

Figure 7:
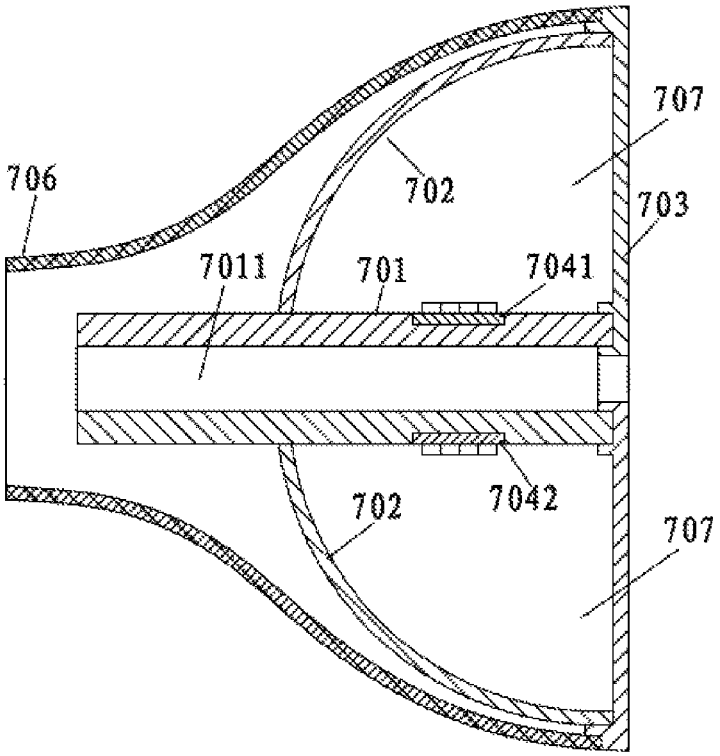
FIG. 7 is a sectional structure schematic view of a LED light source with a heat-dissipation device according to a second embodiment of the present invention.

Embodiment 2:

It can be referred to FIG. 7.

The embodiment provides a LED light source with a heat-dissipation base 701, and the differences between this embodiment and Embodiment 1 are given:

In the embodiment, circuit bases 7041 and 7042 are fixed on at least two opposite faces of the heat-dissipation base 701 of the LED light source.

A light-distribution lens 702 is sleeve connected outside the heat-dissipation 701, and a housing is sleeve connected outside the light-distribution lens 702, the front ends of the light-distribution lens 702 and housing are fixed jointed to the light-transmitting cover 703, the circuit bases 7041 and 7042 located on each surface of the heat-dissipation base 701 and all of LEDs on each circuit bases 7041 and 7042 are located within a sealed chamber 707 formed by the light-distribution lens 702, heat-dissipation base 701 and light-transmitting cover 703, and the sealed chamber 707 is around the periphery of the heat-dissipation base 701.

The heat dissipation principle and the corresponding technical advantages are the same as Embodiment 1. Since the LEDs are distributed on a plurality of faces of the heat-dissipation base 701, the scope of illumination is wider and light intensity is higher.

Similarly to FIGS. 1-4 of Embodiment 1, at least one tubular channel 7011 is arranged within the heat-dissipation base 701, two opposite openings of the tubular channel 7011 are connected to the exterior, as the same as the tubular channel 7011 recorded in Embodiment 1, the tubular channel 7011 on the heat-dissipation base 701 may arranged in the light-transmitting cover 703 and housing, but also whose front end is extended outside the light-transmitting 703. The rear end of the tubular channel 7011 may be further extended outside the housing, and both of the front and rear ends of tubular channel 7011 are extended outside the housing and the light-transmitting cover 703.

As same as Embodiment 1, the circuit bases 7041 and 7042 for fixing LEDs may be widely used PCB or the likes, or it can be used as the technical solutions shown in FIGS. 6 and 7, whose advantages are referred to the disclosure of Embodiment 1.

Figure 8:
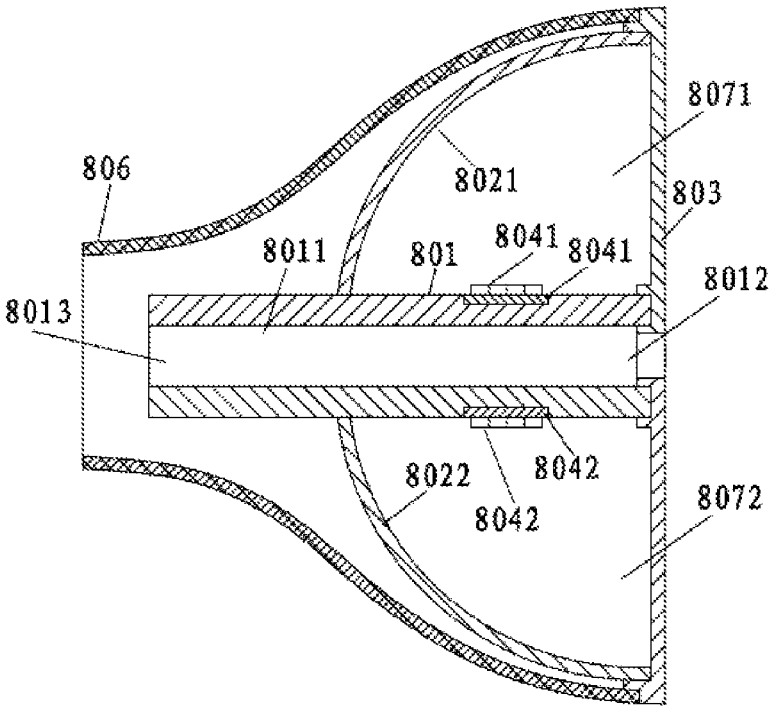
FIG. 8 is a sectional structure schematic view of a LED light source with a heat-dissipation device according to a third embodiment of the present invention.

Embodiment 3:

It can be referred to FIG. 8.

In the embodiment, at least one circuit bases 8041 and 8042 is fixed on the top and bottom surfaces of a large-area heat-dissipation base 801, LEDs 8051 and 8052 are fixed separately on the circuit bases 8041 and 8042. The detailed connection of the circuit substrate, LEDs 8051 and 8052 may be, but not limited to the description referred to Embodiment 1 and 2.

Light-distribution lenses 8021 and 8022 are sleeve connected outside the heat-dissipation 801, and a housing 806 is sleeve connected outside the light-distribution lenses 8021 and 8022, front ends of the housing 806, the light-distribution lenses 8021 and 8022 are separately fixed jointed to the light-transmitting cover 803; the circuit base 8041 located at the top surface of the heat-dissipation base 801 and the LEDs are located within a first sealed chamber 8071 formed by the light-distribution lens 8021, heat-dissipation base 801 and light-transmitting cover 803, and the circuit base 8042 located at the bottom surface of the heat-dissipation base 801 and the LEDs are located within a second sealed chamber 8072 formed by the light-distribution lens 8022, heat-dissipation base 801 and light-transmitting cover 803.

At least a tubular channel 8011 is arranged within the heat-dissipation base 801, and two opposite openings 8012 and 8013 of each channel 8011 are connected to the exterior.

Similarly to FIGS. 1-4 of Embodiment 1, particularly to the tubular channel 8011 of Embodiment 1, the tubular channel 8011 on the heat-dissipation base 801 may located within the light-transmitting cover 803 and housing 806, but also whose front end may be extended outside the light-transmitting 803. The rear end of the tubular channel 8011 may be further extended outside the housing 806, and both of the front and rear ends of tubular channel 8011 may be extended outside housing 806 and the light-transmitting cover 803. The detailed working principle and advantages can be referred to the description of Embodiment 1.

It should be described that when applying the above embodiment, except the designs in the Embodiments 1 and 2, the LED light source as shown in FIG. 1-4 and 7 of the Embodiment 1 and 2 may be a unit, and a plurality of units may be combined together so as to form a large-scale intense-light LED light source matrix with good performance of heat dissipation, which may achieve intense-light, oriented and energy-saving illumination of the LEDs with good performance of heat dissipation.

For further describing the effect of the present invention, it is presented the following tests to the high-power LED lamp produced by the embodiment.

Testing environment: under room temperature, and blasting air to the second chamber 111 at the first through hole 112 underlie the lens 103 with the speed of 2 m/s, so as to simulate the gas fluid during vehicle moving process.

Tested object 1: LED lamp with power of 100 W.

Testing environment: under room temperature, and blasting air to the second chamber 111 at the first through hole 112 underlie the lens 103 with the speed of 2 m/s, so as to simulate the gas fluid during vehicle moving process.

In the above testing environment, after continuous work of LED lamp for 1 hour, testing the temperature at the surface of main heat-dissipation base where is 0.3 mm away from periphery of the LED chip by means of infrared temperature detector. The measured temperature is 50.2□, and the surface temperature of upper-beam LED chip is 55.6□;

After continuous work of LED lamp for 2 hours, testing the temperature at the surface of main heat-dissipation base where is 0.3 mm away from periphery of the LED chip by means of infrared temperature detector. The measured temperature is 52.2□, and the surface temperature of upper-beam LED chip is 58.6□.

Tested object 2: LED lamp with power of 1000 W, adaptively, it should be increase the volume of heat-dissipation base, as shown in FIG. 4, the heat-dissipation base is extended outside the front end of the light-transmitting cover 403, whose rear end is extended outside the rear end of the housing 106, wherein the channels are tubular channels;

Testing environment: under room temperature, and blasting water to the second chamber 111 from the tubular channel 3011 with the speed of 2 m/s, so as to simulate the water fluid during steamship moving process.

In the above testing environment, after continuous work of LED lamp for 1 hour, testing the temperature at the surface of main heat-dissipation base where is 0.3 mm away from periphery of the LED chip by means of infrared temperature detector. The measured temperature is 45.2□, and the surface temperature of upper-beam LED chip is 50.6;

After continuous work of LED lamp for 2 hours, testing the temperature at the surface of main heat-dissipation base where is 0.3 mm away from periphery of the LED chip by means of infrared temperature detector. The measured temperature is 52.2□, and the surface temperature of upper-beam LED chip is 55.6□.

It can be seen that the embodiment of the present invention may achieve high-power LED illumination and high efficiency of heat dissipation through fluids cut-through. It should be appreciated that the embodiment may be applied to various occasions of high-power illumination and LED head lamps of motor, automobile and steamship etc., particularly to high-power lighting equipment outdoor, which may utilize natural wind or rain to achieve the heat dissipation; The embodiment may further applied to illumination of mobile devices, which utilizing reverse gas or water fluid produced in the moving process of the devices to achieve cut-through of the fluids and high efficiency of heat dissipation.

The embodiments of the present invention are illustrated in detail above by some examples with working principle and implementation plan, which is to help understanding principles of embodiments according to the present invention; meanwhile, person of ordinary skill in the art can make variations and modifications to the present invention in terms of the specific implementations and application scopes according to the ideas of the embodiments of the present invention. Therefore, the specification shall not be construed as a limit to the present invention.

What is claimed is:

1. A LED light source, comprising a heat-dissipation base, a circuit base is fixed on the heat-dissipation base, and luminous LED(s) is fixed on the circuit base, a light-distribution lens is sealed connected outside the heat-dissipation base, a housing is fixed outside the light-distribution lens, and front ends of the housing and the light-distribution lens are separately fixed jointed to a light-transmitting cover, the light-transmitting cover is sealed connection with the heat-dissipation base, the circuit base and LEDs are located within a sealed first chamber formed by the heat-dissipation base, light-distribution lens and light-transmitting cover, at least a channel is further arranged on the heat-dissipation base, each channel is disconnected to the first chamber, and two opposite openings of each channel are connected to the exterior;

rear end of the heat-dissipation base is extended outside rear end of the housing, an opening of each channel is located outside the rear end of the housing wherein the heat-dissipation base is extended outside the light-transmitting cover, at least a through hole is arranged on periphery of connection part of the light-transmitting cover and the heat-dissipation base, part of the heat-dissipation base is cut through the through hole of the light-transmitting cover and extended outside the light-transmitting cover, an opening of each channel on the heat-dissipation base is located outside the light- transmitting cover.

2. The LED light source according to claim 1, wherein:

the channels are tubular channels formed in the heat-dissipation base; or a plurality of fins are formed on surface of the heat-dissipation base, the channels are grooved channels between any two adjacent fins.

3. The LED light source according to claim 1, wherein:

all parts of the heat-dissipation base are located on one side of the light-transmitting cover, at least a through hole is arranged on periphery of connection part of the light-transmitting cover and the heat-dissipation base, each through hole is opposite to the opening of each channel on the heat-dissipation base.

4. The LED light source according to claim 1, wherein:

two opposite chimbs are further arranged on the connection part of the light-transmitting cover and the heat-dissipation base;

the light-transmitting cover is sealed connected with the heat-dissipation base, that is:

the connection part of the light-transmitting cover and the heat-dissipation base is spacing sealed fixed between two chimbs of the light-transmitting cover.

5. The LED light source according to claim 1, wherein:

a first chimb is arranged on the connection part of the housing and the light-distribution lens on the light-transmitting cover, the front ends of the housing and the light-distribution lens are separately fixed to the light-transmitting cover, that is:

the housing is face-to-face sealed fixed on outer side of the first chimb of the light-transmitting cover, the light-distribution lens is face-to-face sealed fixed on inner side of the first chimb.

6. The LED light source according to claim 1, wherein:

the circuit base comprising: metal substrate, insulated-based material, and routing copper foil;

the LEDs are LED chips, and each LED chip is fixed on the surface of the metal substrate, a insulated layer at the bottom surface of each LED chip is face-contacted with the metal substrate, an electrode pin of each LED chip is welded on the metal substrate, and another electrode pin is electrically connected with the routing copper foil lay in the insulated-based material via lead;

wherein, the insulated-based material is lay on the top surface of the metal substrate except the LED chip fixed area, the routing copper foil is lay in the insulated-based material;

the metal substrate and the routing copper foil are separately electrically connected with anode and cathode of an external supply circuit.

7. The LED light source according to claim 6, wherein:

a pit is further arranged on the top surface of the metal substrate, the LED chips are fixed on the surface of the metal substrate, that is: the LED chips are fixed on the surface of the pit, the insulated-based material is lay on the top surface of the metal substrate except the LED chip fixed area, that is:

the insulated layer is lay on the top surface area of the metal substrate except the pit area;

another electrode pin of each LED chip is electrically connected with the routing copper foil, that is: another electrode pin of each LED chip is electrically connected with the routing copper foil via the lead;

a silica gel filled part is filled in the pit, and all of the LED chips and leads are packed in the silica gel filled part.

8. A LED light source, comprising: a heat-dissipation base, circuit bases are separately fixed on top and bottom surfaces of the heat-dissipation base, and luminous LED(s) is fixed on each circuit base;

a light-distribution lens is sleeve connected outside the heat-dissipation, a housing is sleeve connected outside the light-distribution lens, the front ends of the housing and light-distribution lens are separately fixed on the light-transmitting cover;

the circuit base located on the top surface of the heat-dissipation base and the LED are located within a first sealed chamber formed by the light-distribution lens, heat-dissipation base and light-transmitting cover, the circuit base located on the bottom surface of the heat-dissipation base and the LED are located within a second sealed chamber formed by the light-distribution lens, heat-dissipation base and light-transmitting cover, at least a tubular channel is further arranged within the heat-dissipation base, and two opposite openings of each channel are connected to the exterior.

9. The LED light source according to claim 8, wherein, the rear end of the heat-dissipation base is extended outside the rear end of the housing, an opening of each channel is located outside the rear end of the housing.

10. The LED light source according to claim 8, wherein, all parts of the heat-dissipation base are located on one side of the light-transmitting cover, at least a through hole is arranged on the light-transmitting cover, and each through hole is opposite to the opening of each channel on the heat-dissipation base.

11. The LED light source according to claim 8, wherein, the heat-dissipation base is extended outside the light-transmitting cover, through hole(s) is arranged on periphery of connection part of the light-transmitting cover and the heat-dissipation base, part of the heat-dissipation is cut through the through hole of the light-transmitting cover and extended outside the light-transmitting cover, an opening of each channel on the heat-dissipation base is located outside the light-transmitting cover.

12. The LED light source according to claim 8, wherein, two opposite chimbs are further arranged on the connection part of the light-transmitting cover and the heat-dissipation base ;

the light-transmitting cover is sealed connected with the heat-dissipation base, that is:

the connection part of is spacing sealed fixed between two chimbs of the light-transmitting cover.

13. The LED light source according to claim 8, wherein:

a first chimb is arranged on the connection part of the housing and the light-distribution lens on the light-transmitting cover, the front ends of the housing and the light-distribution lens are separately fixed to the light-transmitting cover, that is:

the housing is face-to-face sealed fixed on outer side of the first chimb of the light-transmitting cover, the light-distribution lens is face-to-face sealed fixed on inner side of the first chimb.

14. The LED light source according to claim 8, wherein:

the circuit base comprising: metal substrate, insulated-based material, and routing copper foil;

the LEDs are LED chips which are fixed on the surface of the metal substrate, a insulated layer at the bottom surface of each LED chip is face-contacted with the metal substrate, an electrode pin of each LED chip is welded on the metal substrate, and another electrode pin is electrically connected with the routing copper foil lay in the insulated-based material via lead;

wherein, the insulated-based material is lay on the top surface of the metal substrate except the LED chip fixed area, the routing copper foil is lay in the insulated-based material;

the metal substrate and the routing copper foil are separately electrically connected with anode and cathode of an external supply circuit.

15. The LED light source according to claim 8, wherein:

a pit is further arranged on the top surface of the metal substrate, the LED chips are fixed on the surface of the metal substrate, that is: the LED chips are fixed on the surface of the pit, the insulated-based material is lay on the top surface of the metal substrate except the LED chip fixed area, that is:

the insulated layer is lay on the top surface area of the metal substrate except the pit area;

another electrode pin of each LED chip is electrically connected with the routing copper foil, that is: another electrode pin of each LED chip is electrically connected with the routing copper foil via the lead;

a silica gel filled part is filled in the pit, and all of the LED chips and leads are packed in the silica gel filled part.

* * * * *